US005479979A

United States Patent [19]

Hayashiguchi

[11] Patent Number: 5,479,979

[45] Date of Patent: Jan. 2, 1996

[54] SCREEN DEVICE

[75] Inventor: Seizo Hayashiguchi, Tsu, Japan

[73] Assignee: Hayashiguchi Mfg. Co., Ltd., Mie, Japan

[21] Appl. No.: 209,629

[22] Filed: Mar. 14, 1994

[30] Foreign Application Priority Data

Aug. 5, 1993 [JP] Japan ..... 5-194639
Dec. 10, 1993 [JP] Japan ..... 5-310428

[51] Int. Cl.[6] ..... A47G 5/02

[52] U.S. Cl. ..... 160/265; 160/273.1

[58] Field of Search ..... 160/265, 310, 160/22, 23.1, 26, 32, 33, 66, 268.1, 270, 271, 273.1, 319, 320, 133

[56] References Cited

U.S. PATENT DOCUMENTS 4,606,157 8/1986 Esposito ..... 160/310 X
4,884,617 12/1989 Coenraets ..... 160/310 X
5,280,818 1/1994 Ubelhart ..... 160/265
5,287,908 2/1994 Hoffmann et al. ..... 160/265 X

*Primary Examiner*—David M. Purol
*Attorney, Agent, or Firm*—Wenderoth, Lind & Ponack

[57] ABSTRACT

A screen device includes a pair of parallel side frames, a take-up shaft mounted between ends of the side frames, and a screen wound around the take-up shaft and having a bar secured to its free end. The side frames have guide grooves formed in their opposing sides. The bar has both ends thereof received in the grooves in the side frames. Wires having their leading ends connected to the bar are taken up by a wire take-up drum. A constant force spring urges the wire take-up drum to rotate in such a direction that each wire is wound around the wire take-up drum, thereby applying tension to the screen.

1 Claim, 9 Drawing Sheets

SCREEN DEVICE

BACKGROUND OF THE INVENTION

This invention relates to a screen device for use e.g. as a sunshade for a sunroom.

A known screen device has a prism-shaped case and a take-up shaft mounted in the case and biased in such a direction that a screen connected to the take-up shaft will be taken up around the shaft. The screen has its side edges received in guide grooves formed in a pair of parallel side frames so as to be movable therealong.

To the free end of the screen is coupled a control bar having its ends received in the guide grooves in the side frames. By sliding the bar along the guide grooves, the screen can be opened and closed. Thus, such a screen device has to be installed at such a low level that the control bar is accessible to an ordinary person. In other words, it was impossible to use such a screen device as a sunshade for a window provided at a high place such as in the ceiling of a sunroom.

SUMMARY OF THE INVENTION

An object of this invention is to provide a screen device which can be used as a sunshade for a window provided at a high place.

According to this invention, there is provided a screen device comprising a pair of parallel side frames, a take-up shaft mounted between ends of the side frames, a screen wound around the take-up shaft and having a bar secured to its free end, the side frames having guide grooves formed in their opposing sides, the bar having both ends thereof received in the grooves in the side frames, wires having their leading ends connected to the bar, and wire take-up means each comprising a wire take-up drum for taking up each wire and a constant force spring for urging the wire take-up drum to rotate in such a direction that each wire is wound around the wire take-up drum, thereby applying tension to the screen.

The take-up shaft may be provided with a spring for rotating the shaft in the take-up direction, a rotary wheel such as a sprocket mounted coaxially to the take-up shaft and an endless string extending around the wheel so as to manually rotate the rotary wheel and thus the take-up shaft. Alternatively, the take-up shaft may be power-driven by a motor. Thus, the screen device according to this invention can be used as a sunshade for a window provided at a high place.

By rotating the take-up shaft in such a direction that the screen is unwound, the wires are wound around the wire take-up drum by a length equal to the length by which the screen is unrolled. Thus, the screen can be pulled off of the take-up shaft.

By using a constant force spring as the spring for biasing the wire take-up drum in the wire take-up direction, it is possible to keep constant the tension of the screen irrespective of whether the screen is open or closed or irrespective of its mounting position. For example, the screen can be slid smoothly irrespective of whether the screen device is mounted vertically, horizontally or obliquely.

Since the pulling force applied to the screen by the wire take-up drum through the wires is set slightly smaller than the winding force applied to the screen by the take-up shaft, the screen can be pulled out and stopped at any desired position.

BRIEF DESCRIPTION OF THE DRAWINGS

Other features and objects of the present invention will become apparent from the following description made with reference to the accompanying drawings, in which.

DETAILED DESCRIPTION OF THE PREFERRED EMBODIMENT

Figure 1:
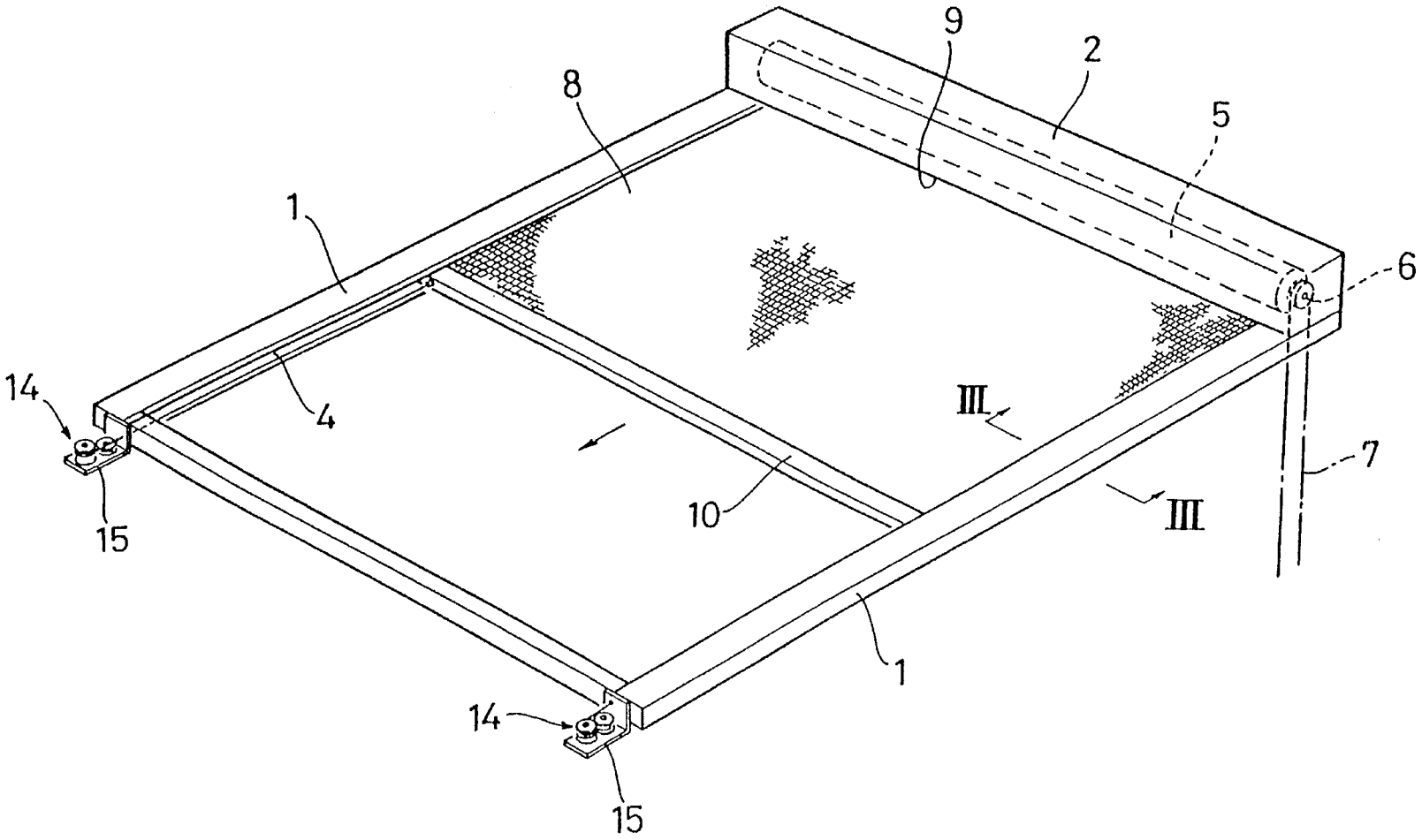
FIG. 1 is a perspective view of a first embodiment of the screen device according to this invention.

The embodiments of this invention will now be described with reference to the accompanying drawings.

FIGS. 1–4 show the first embodiment of the screen device according to this invention.

As shown, a pair of side frames 1 extend parallel to each other. A square pole-shaped case 2 is mounted between the side frames 1 at one end thereof. Between the other ends of the side frames 1 are mounted a spacer frame 3.

The side frames 1 have longitudinal guide grooves 4 disposed opposite to each other.

A take-up shaft 5 is mounted in the case 2. It is biased in a take-up direction by an unillustrated spring.

A rotary wheel 6 is coaxially mounted on one end of the take-up shaft 5. An endless string 7 extends around the rotary wheel 6. The take-up shaft 5 can be rotated by moving the string 7 in either direction.

A screen 8 is connected to the take-up shaft 5 and can be taken up by the shaft. The screen is a sheet which can be cylindrically rolled up and may be made of cloth, net or slats according to the intended use. For example, if it is desired to use this screen device as a sunshade, the screen 8 should be made of a material having sun-shielding properties.

The screen 8 is pulled out of the case 2 through its opening 9. To its free end is coupled a bar 10. The bar 10 has its both ends received in the guide grooves 4 in the side frames 1 so as to be slidable therealong.

Flexible engaging pieces 11 are attached to both side edges of the screen 8. In the guide grooves 4 of the side frames 1 are mounted inner rails 12 for supporting and guiding both side edges of the screen 8. The inner rails 12 are biased outwardly by elastic members 13. The engaging pieces 11 are in engagement with the inner rails 12, so that the screen 8 is tensioned widthwise.

Figure 4:
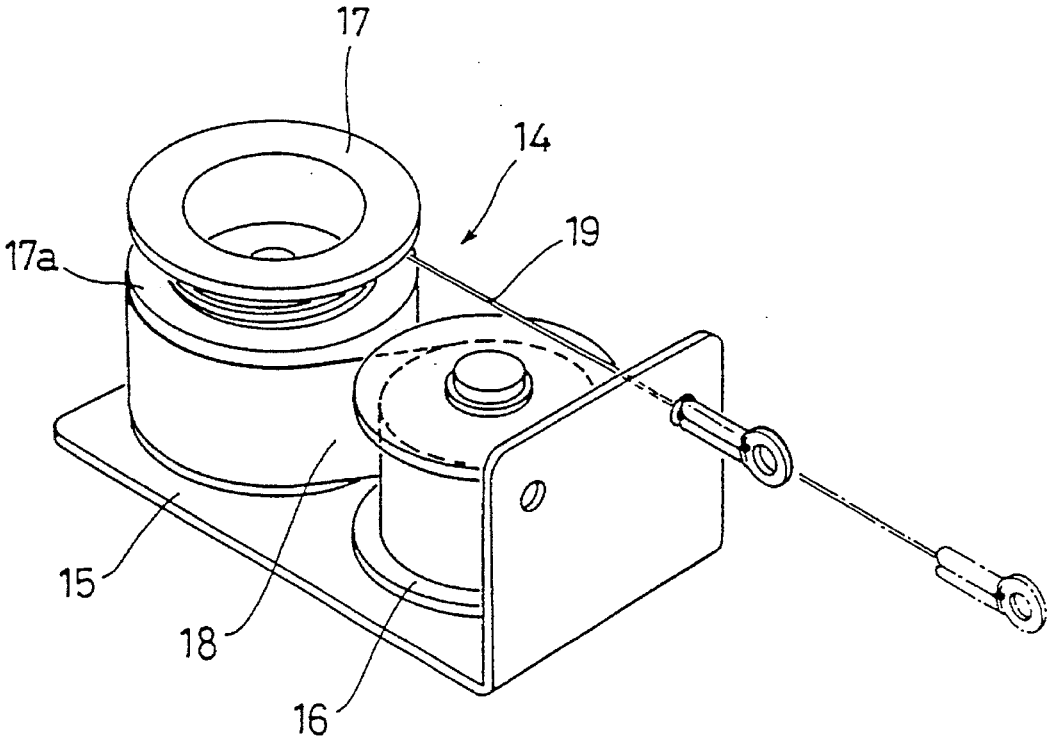
FIG. 4 is a perspective view of the wire take-up mechanism of the same.

A wire take-up 14 is mounted to one end of each side frame 1. As shown in FIG. 4, the wire take-up 14 comprises a bracket 15 secured to the end of the side frame 1, a spring support drum 16 and a wire take-up drum 17 rotatably mounted on the bracket 15, and a strip of constant force spring 18 which is spiral when not stressed and which is wrapped around the spring support drum 16. Its front end is secured to a spring take-up barrel 17*a* provided on the wire take-up drum 17 so that the wire take-up drum 17 is biased in such a direction that a wire 19 is taken up by the drum 17.

As the constant force spring 18, we used a spring made by Sanko Spring Co., Ltd., sold under the trade name CONSTON.

The end of the wire 19 pulled out of the wire take-up drum 17 of each wire take-up 14 is coupled to the bar 10. The force with which the bar 10 is pulled by the wire take-ups 14 is slightly smaller than the pulling force applied to the bar 10 by the take-up shaft 5 through the screen 8.

Figure 2:
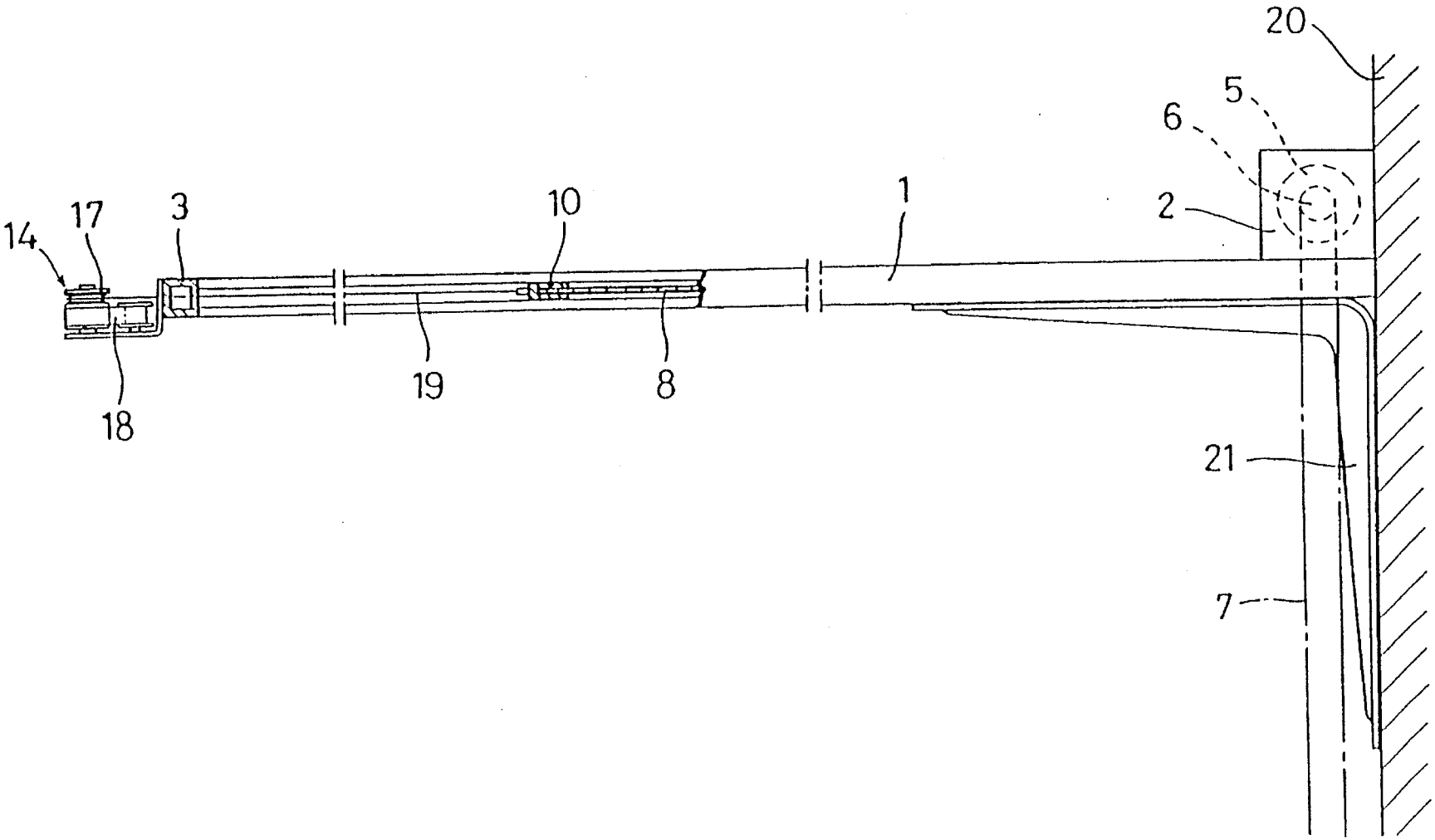
FIG. 2 is a partially cutaway side view of the same.
Figure 3:
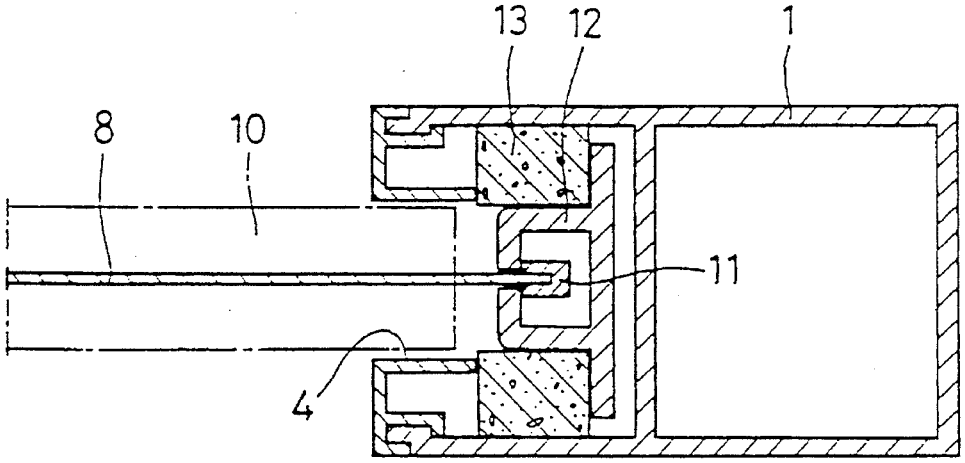
FIG. 3 is a sectional view taken along line III—III of FIG. 1.

If it is desired to use the screen device of the first embodiment as a sunshade for a window provided in the ceiling of a sunroom, the side frames 1 are supported on a support member 21 mounted on a wall surface 20 as shown in FIG. 2 so that the screen 8 can be pulled out along the unshown ceiling.

With the screen device mounted as shown, when the take-up shaft 5 is turned in such a direction that the screen 8 is unrolled by pulling the string 7, the wires 19 are taken up by the wire take-up drums 17 by a length equal to the length by which the screen 8 is unrolled. As the wires 19 are taken up by the drums 17, the bar 10 is pulled along the guide grooves 4 in the side frames 1. The screen 8 is thus pulled out by a length corresponding to the number of rotations of the take-up shaft 5.

Since the force with which the bar 10 is pulled by the wire take-ups 14 through the wires 19 is slightly smaller than the pulling force applied to the bar 10 by the take-up shaft 5 through the screen 8, the screen 8 can be stopped and maintained at any desired position by stopping the take-up shaft 5.

Figure 5:
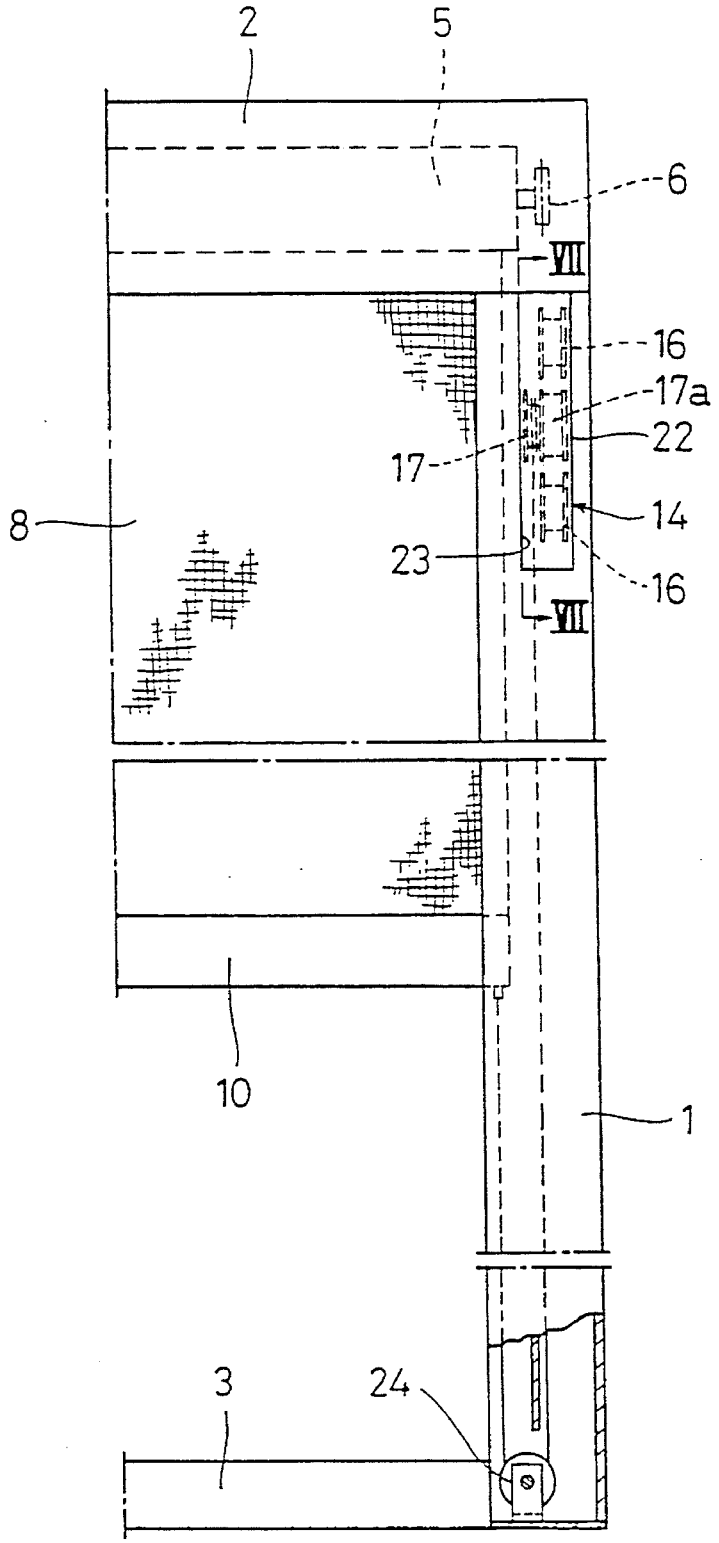
FIG. 5 is a partially cutaway plan view of a portion of a second embodiment of the screen device according to this invention.
Figure 6:
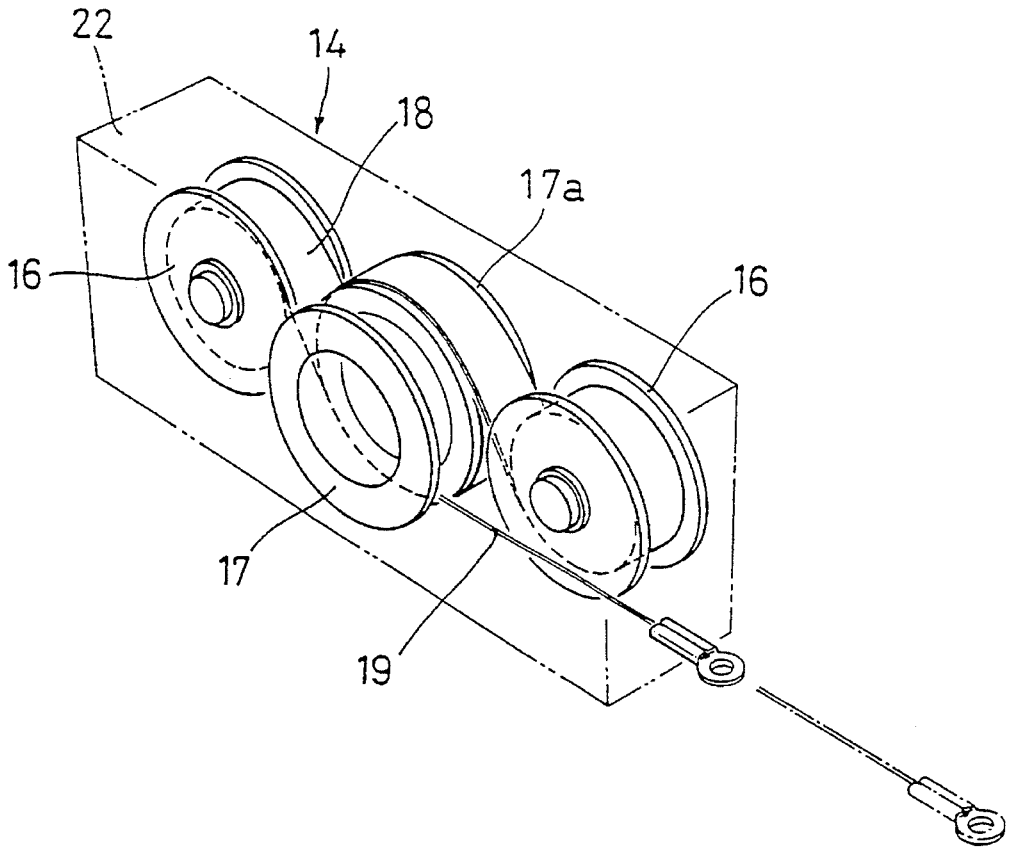
FIG. 6 is a perspective view of the wire take-up mechanism of the same.
Figure 7:
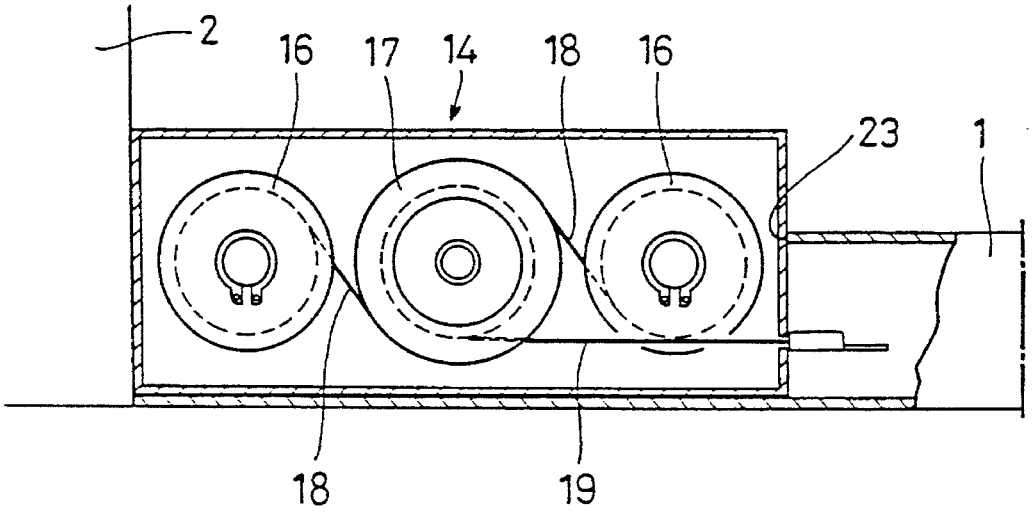
FIG. 7 is a sectional view taken along line VII—VII of FIG. 5.
Figure 8:
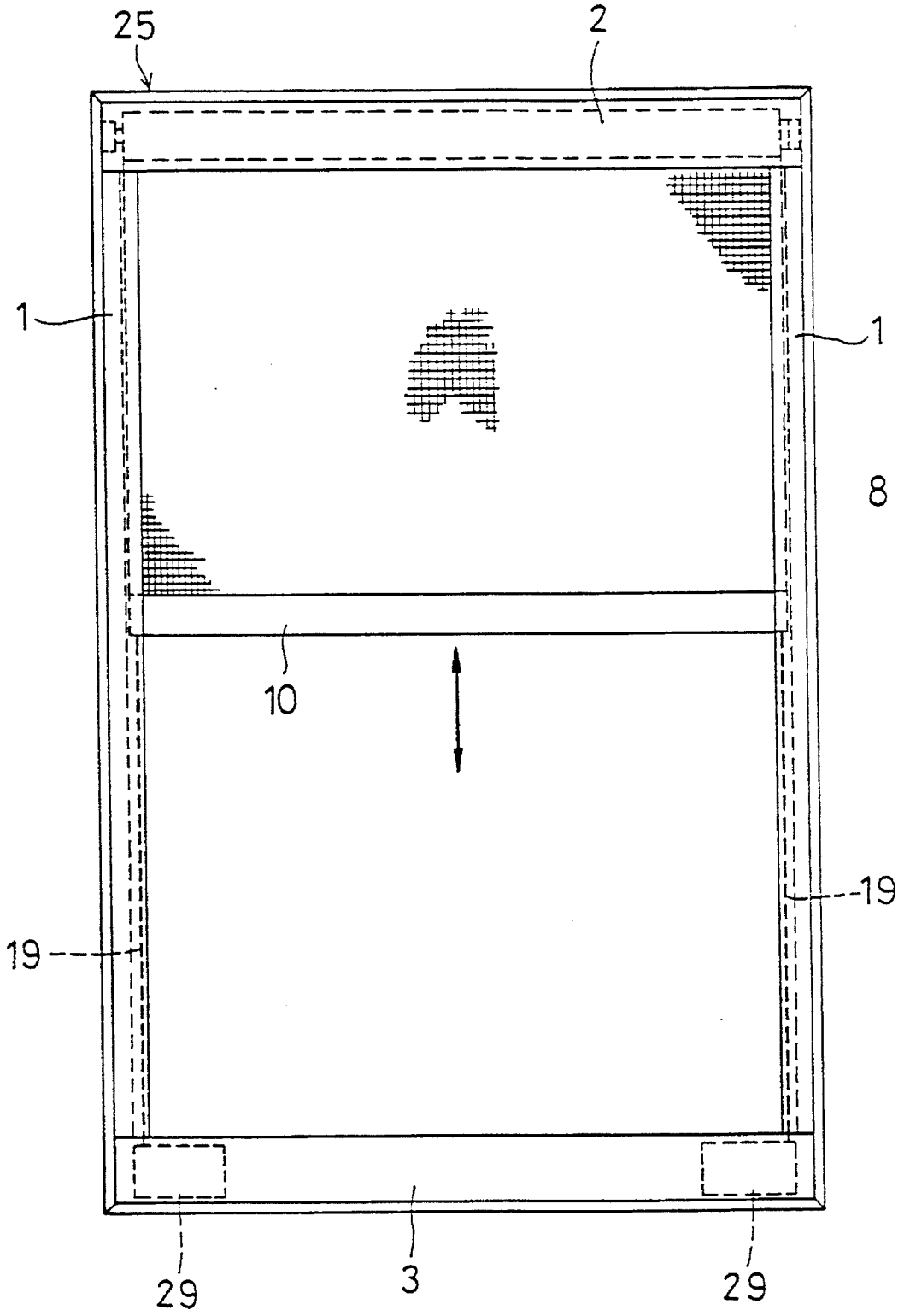
FIG. 8 is a front view of a third embodiment of the screen device according to this invention.
Figure 9:
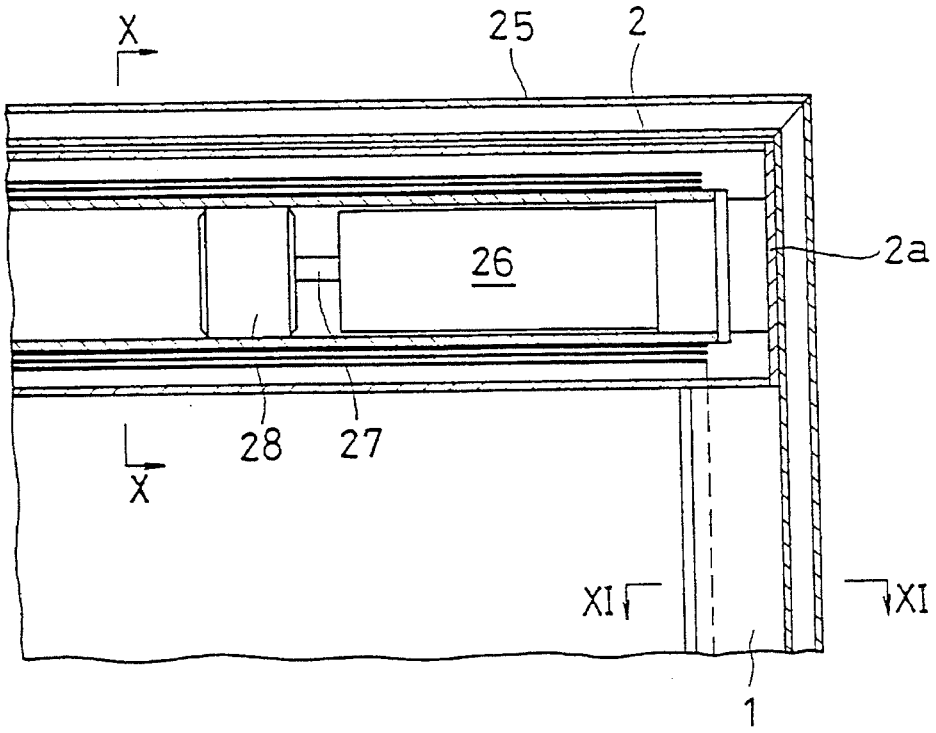
FIG. 9 is a sectional view of the take-up shaft of the same.
Figure 10:
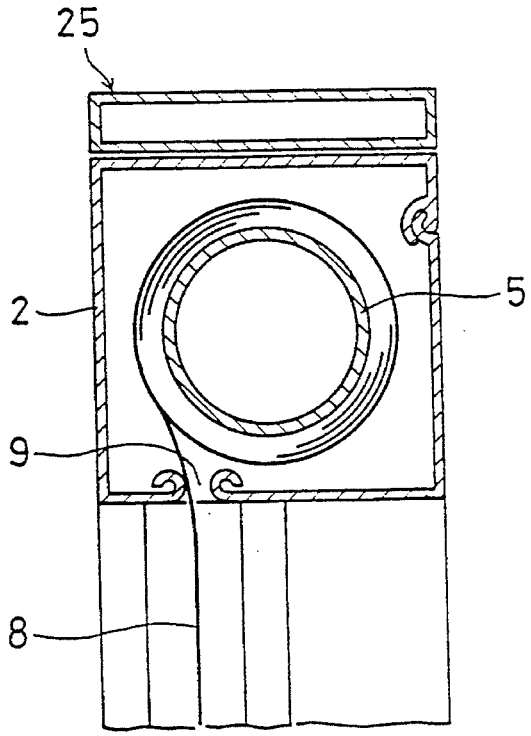
FIG. 10 is a sectional view taken along line X—X of FIG. 9.
Figure 11:
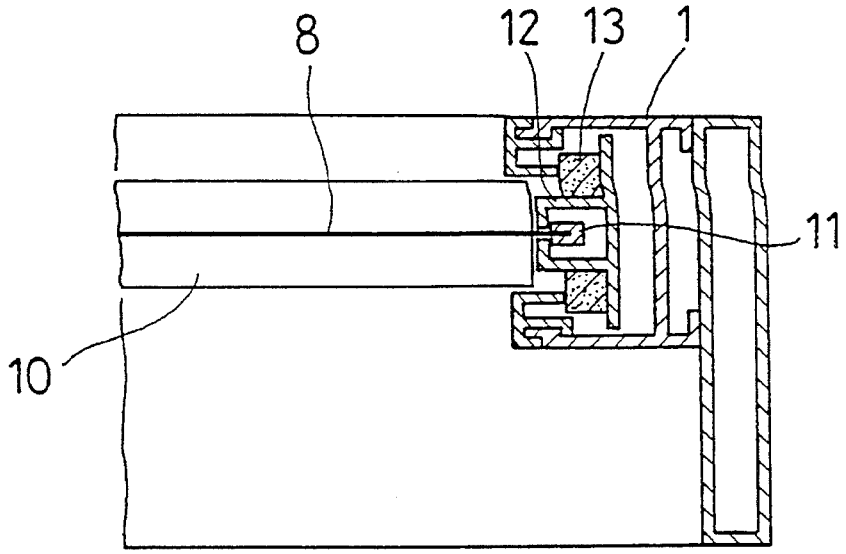
FIG. 11 is a sectional view taken along line XI—XI of FIG. 9.
Figure 12:
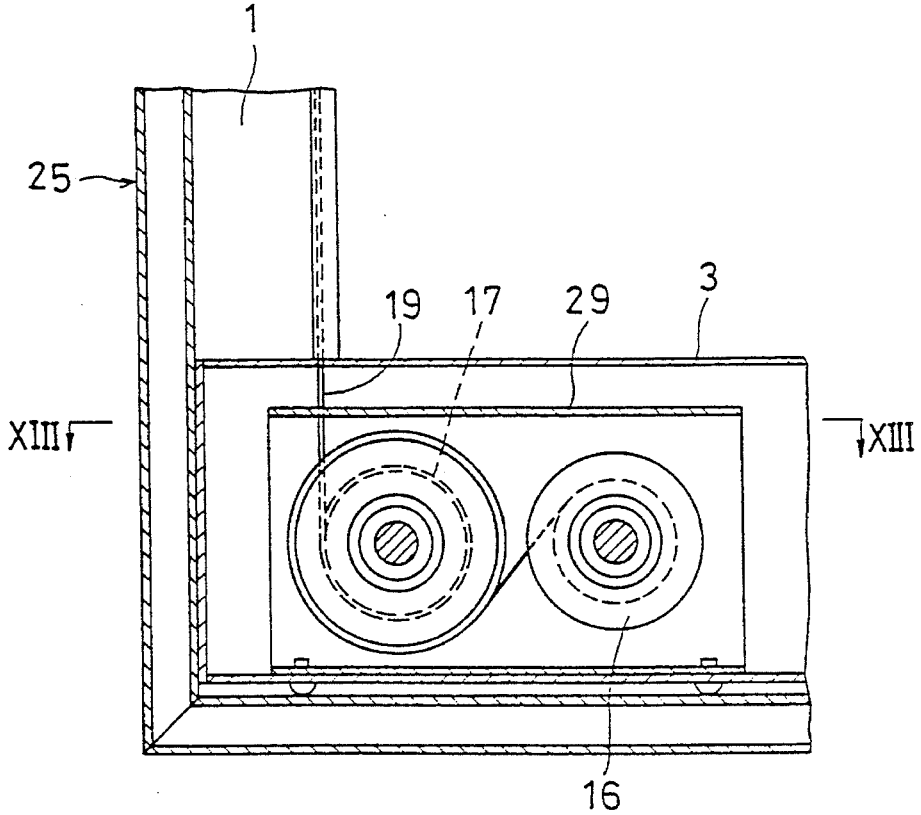
FIG. 12 is a sectional view of the take-up mechanism of the same.
Figure 13:
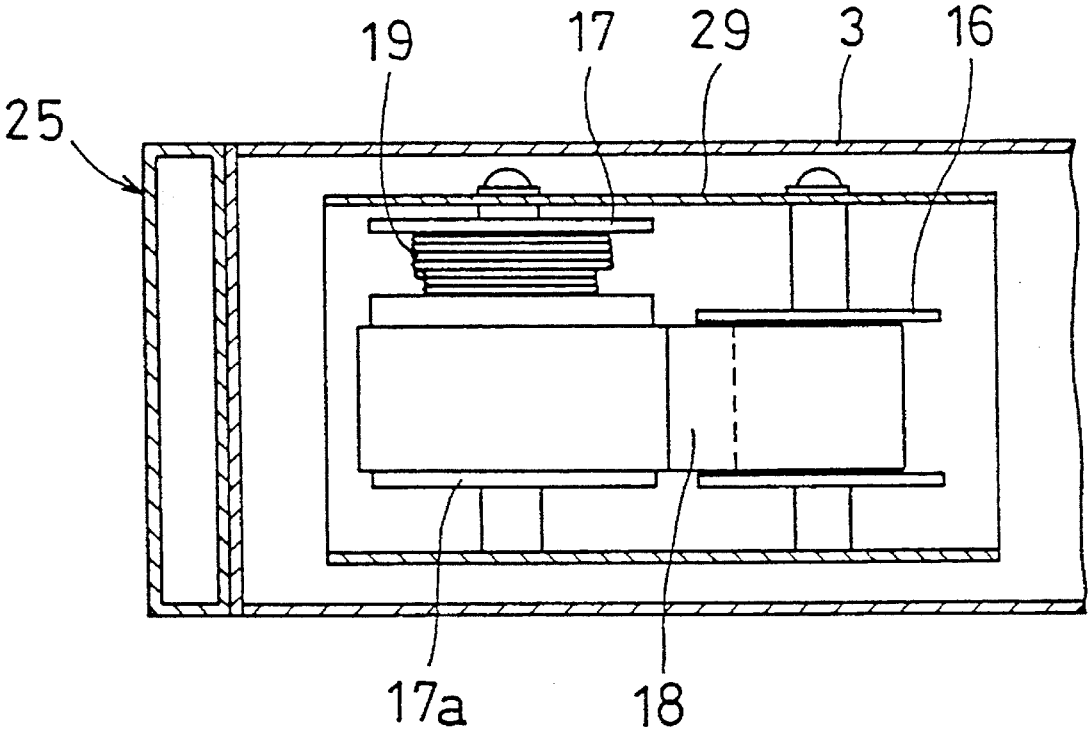
FIG. 13 is a sectional view taken along line XIII—XIII. XIII of FIG. 12.

FIGS. 5–7 show the second embodiment of the screen device according to this invention. In this embodiment, an opening 23 is formed in the other end of each side frame 1 in which is received a case 22 accommodating a wire take-up 14. A wire 19 pulled out of each case 22 extends around a pulley 24 rotatably mounted on the front end of the side frame 1 and is coupled at its leading end to the bar 10.

Each wire take-up 14 comprises a wire take-up drum 17, spring support drums 16 rotatably mounted on both sides of the wire take-up drum 17, and spiral constant force springs 18 fitted on the respective spring support drums 16 and having their ends coupled to the wire take-up drum 17 so that the wire take-up drum 17 is biased in such a direction that the wire 19 is taken up by the drum 17. The wire take-up 14 of this embodiment is advantageous over the wire take-up 14 of the first embodiment because, by using two constant force springs 18 instead of one, it is possible to reduce the width of each spring and thus the thickness of the wire take-up 14.

The screen device of this embodiment is used in the same way as that of the first embodiment. Thus, the description of its operation is omitted.

FIGS. 8–13 show the third embodiment of the screen device according to this invention. In this embodiment, a pair of side frames 1 are fixed inside a rectangular mounting frame 25. A square pole-shaped case 2 is mounted between the side frames 1 at one end of each frame. Between the other ends of the side frames 1 is mounted a spacer frame 3.

A motor 26 having a speed reducer is mounted in the case 2 at its inner end and is supported on an end plate 2*a* of the case 2. The motor 26 has an output shaft 27 to which is secured a disk 28 which is fixed to the take-up shaft 5. By driving the motor 26, the take-up shaft 5 can be rotated in either direction.

The spacer frame 3 is cylindrical and is provided therein with cylindrical support frames 29. In each support frame 29 are mounted a support drum 16 and a wire take-up drum 17. A constant force spring 18 is supported on the spring support drum 16 and has its leading end coupled to a spring take-up barrel 17*a* provided on the wire take-up drum 17. A wire 19 wound around the wire take-up drum 17 is pulled out in a direction perpendicular to the direction in which the drums 16, 17 are arranged and connected to each end of the bar 10.

Since two sets of spring support drums 16 and wire take-up drums 17 are supported on the respective support frames 29, they can be supported stably.

Since the wires 19 are pulled out of the respective sets of drums 16 and 17 in a direction perpendicular to the direction in which the drums 16, 17 are arranged, they will never contact the spring support drums 16 when they are pulled out or in. Thus, they can be pulled out and in smoothly.

Except for the above-discussed points, this embodiment is structurally the same as the first embodiment. Thus, like parts are denoted by like numerals and their description is omitted.

In the third embodiment, the turning torque applied to the take-up shaft 5 by the motor 26 is set to be slightly larger than the pulling force applied to the screen 8 by the wire take-up drums 17 through the wires 19 in order to prevent the screen 8 from being pulled out spontaneously from the take-up shaft 5.

What is claimed is:

1. A screen device comprising: a pair of parallel side frames, said side frames defining guide grooves in sides thereof that oppose each other; a take-up shaft mounted between first ends of said side frames; a screen wound around said take-up shaft; a bar secured to a free end of said screen, said bar having both ends thereof received in said guide grooves, respectively; engaging pieces attached to opposite side edges of said screen, respectively; a pair of rails disposed in the side frames, each of said rails engaging a respective one of said engaging pieces to thereby maintain the side edges of said screen within said side frames, respectively; elastic members interposed between said rails and said side frames and supporting said rails on said side frames so as to tension said screen in the widthwise direction thereof; wires having leading ends attached to said bar; wire take-up drums around which said wires are wrapped, respectively, and constant force springs urging said wire take-up drums to rotate in directions in which said wires tend to be wound around said wire take-up drums, respectively, thereby tensioning said screen in the longitudinal direction thereof.

* * * * *